US005992531A

United States Patent [19]

Mikulec

[11] Patent Number: 5,992,531

[45] Date of Patent: Nov. 30, 1999

[54] FIRE EXTINGUISHER

[76] Inventor: Conrad S. Mikulec, 214 E. Treehaven, Buffalo, N.Y. 14215

[21] Appl. No.: 08/922,177

[22] Filed: Sep. 2, 1997

[51] Int. Cl.[6] ..... A62C 11/00

[52] U.S. Cl. ..... 169/33; 239/329; 239/375

[58] Field of Search ..... 169/51, 30, 29, 169/33, 56, 57, 59; 222/386, 541; 239/329, 309, 330, 375

[56] References Cited

U.S. PATENT DOCUMENTS

| | | | |
|---|---|---|---|
| 984,481 | 2/1911 | Hickish | 169/53 X |
| 1,233,290 | 7/1917 | Thomson | 169/29 |
| 1,366,873 | 1/1921 | Carpenter | 169/29 |
| 1,463,518 | 7/1923 | Thomas | 222/386 X |
| 4,083,477 | 4/1978 | Zuttenberg | 222/386 |
| 4,218,013 | 8/1980 | Davison | 239/74 |
| 4,733,799 | 3/1988 | Wiskur | 222/386 X |
| 5,199,614 | 4/1993 | Husman | 222/386 X |

*Primary Examiner*—Kevin Weldon
*Attorney, Agent, or Firm*—Simpson, Simpson & Snyder

[57] ABSTRACT

A fire extinguisher including a spring biased plunger controlled by a trigger mechanism wherein the plunger is mounted in a flame retardant compound container and the spring and plunger cooperate, when the trigger mechanism is activated, to discharge flame retardant compound from the container toward a fire. The extinguisher has a handle end and an outlet end at opposite ends of its length such that a user can hold the outlet end in a remote location away from the user when compound is discharged. The extinguisher can also be mounted and provided with a heat sensor for automatic activation.

21 Claims, 9 Drawing Sheets

258
250
268
280
326
262
264
270

280
310
318
316
312
318
320
314
256
272
258
260
278
290
250
288
284
282
272
296
292
286
294
300
298

FIRE EXTINGUISHER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to fire extinguishers generally and more particularly to a simple spring loaded tubular fire extinguisher which can be either hand held and manually operated or equipped with a heat sensitive fuse link and mounted for automatic operation.

There are many different hand held fire extinguisher systems which can be used to manually extinguish a fire. Most manual extinguishers include either a dry or wet flame retardant chemical compound placed under pressure within a cylindrical canister which includes an opening in a bottom end, a siphon tube connected at one end to the opening and at an opposite end to a valve sealed outlet, an activation device for opening and closing the valve and a nozzle or a nozzle at the end of a hose which can be used to direct the compound toward a flame to extinguish the flame.

In operation, to extinguish a fire, a user directs the nozzle end of the hose toward the base of the fire and triggers the activation device to open the valve. Where the extinguisher includes a hose, the compound is forced therethrough and out the nozzle end to extinguish the fire. Usually, because the compound must travel through the hose prior to being discharged, hose length is limited so that activation time is reduced, pressure required to force the compound through the hose is minimal and minimal compound is wasted within the hose.

These types of extinguishers only work if pressure inside the canister is maintained at a high level. To ensure that pressure is sufficient, most of these types of extinguishers include, in addition to the hardware identified above, a pressure gauge fitted on the valve to visually indicate canister pressure. When canister pressure drops below a threshold level the canister must be recharged prior to use.

While these types of extinguishers are relatively inexpensive, unfortunately, they have a number of shortcomings. For example, while these extinguishers can put out relatively small fires efficiently, they are typically not suitable for extinguishing larger fires. These extinguishers require a user to be located relatively close to a fire in order to extinguish the fire. While a user can get close to a small fire without suffering heat related effects, large fires generate dangerous levels of heat which can scorch a person even though actual contact with the fire is avoided. It is particularly dangerous when an extinguisher is not equipped with an extension hose connected to the nozzle as a user must hold the nozzle adjacent a fire during extinguishment. Even when a hose is provided, as indicated above, to minimize activation time, reduce required canister pressure and minimize wasted compound, most extinguisher hoses are relatively short which means a user has to be near the fire during extinguishment.

Another problem with these types of extinguishers is that required components are expensive. For example, the pressure gauge is expensive. Another relatively expensive component is the canister which must maintain the compound under extreme pressure for extended periods. In addition to meeting pressure requirements under normal conditions, canisters must also meet varying pressure requirements which depend on ambient temperatures which can vary from below freezing to temperatures above 100° F. Moreover, because many of the extinguisher chemical compounds are corrosive, the canisters have to be formed from materials which do not deteriorate when in contact with corrosive chemicals. All of these limitations require specifically constructed canisters which, due to their special construction are relatively expensive.

The task and related expense of providing a suitable canister is even more problematic when exotic canister shapes are desired. For example, space limitations might restrict the depth of a canister even though a space can accommodate a greater relative width. In this case, a canister having an oval or rectangular cross section might be most advantageous. Unfortunately, while such shapes are possible, they are usually cost prohibitive.

In addition, canisters which have to withstand high pressure tend to be heavy. Heavy metals which maintain their shape under pressure are typically used to form the canisters. For example, to provide a canister which can maintain ten pounds of extinguisher material under pressure for an extended period, extinguisher hardware will typically weigh as much as fifteen to twenty pounds for a total loaded canister weight of between twenty-five and thirty pounds.

Another related problem is that heavy extinguishers are difficult to operate. For example, where a large fire occurs or fire exists in a relatively high location (e.g., 6 or more feet above floor level), a user must lift an extinguisher up above the user's head in order to direct retardant compound at the fire. The task of lifting a heavy extinguisher is exacerbated by the necessity that extinguisher position must be relatively controlled so that compound is delivered in intended directions.

Moreover, the task of directing the extinguisher toward a fire is made more difficult by the reality that these extinguishers have to remain upright in order to operate properly. When upright, the retardant compound is located above the canister opening and the pressure causing gas is located thereabove as desired. When the valve is opened, the gas forces the compound out the opening.

Unfortunately, when the canister is not upright, the compound therein shifts under the force of gravity and will assume the lowest possible position inside the canister. For example, if the canister is upside down so that the opening is at the top of the canister, the compound will be opposite the opening. In this case, when the valve is opened the gas, not the compound, is discharged and the extinguisher is ineffective. This is also true where the canister is oriented longitudinally.

To overcome the weight limitations associated with these extinguishers, the pressure inside these extinguishers and the nozzle design are such that compound is discharged at extremely high speeds so that it can travel several feet relatively quickly. Unfortunately, a high pressure compound can often lead to "fire blast" and spreading. "Fire blast" is a term used herein to refer to the occurrence wherein fire can be spread from its original location when combustible materials thereat are blasted from their location. For example, where an extinguisher is used to extinguish a grease fire, the impact of high speed discharged compound can cause ignited grease to be splattered all over an adjacent area which, instead of extinguishing a fire, can spread the fire to the adjacent area.

Yet another problem with these extinguishers is that they have to be routinely maintained in order to remain operable. At the very least, pressure gauges have to be checked every few months to ensure canister pressure is above the required threshold level. Where canister pressure is insufficient, the canister has to be recharged prior to use.

One other problem with these extinguishers which is related to their having to be upright to operate properly is that they malfunction in zero gravity environments. For example, in outer space, where there is no gravity, even when oriented in an upright position with the canister opening at the bottom, because there is no gravitational force on the compound, the compound tends to float inside the canister, compound and gas inside the canister mix and, when the valve is opened, the mixture is discharged instead of pure compound.

In addition to hand held fire extinguishers there are also many different types of mounted fire extinguisher systems configured to automatically extinguish a fire. For example, there are water sprinkler systems which, when heat or smoke are sensed, deliver water through plumbing to one or more areas in a building to extinguish a perceived fire. While these systems are effective, they typically are the most expensive systems available as the plumbing hardware required can be extensive, particularly in large buildings.

Another example of a mounted extinguisher is described in U.S. Pat. No. 4,979,572 entitled FIRE EXTINGUISHER INSTALLATION which issued on Dec. 25, 1990 to the present inventor. That system includes a compact design wherein an extinguisher canister is secured by a two bolt bracket within a stove hood and is connected at an outlet end to a complex configuration of pipes, cables and one or more heat sensitive fuse links. The fuse links are located above the stove so that a fire on or near the stove will melt at least one link. When a link melts the cables cooperate with a trigger mechanism to open the outlet end of the canister. When opened the canister dispenses its contents (i.e. flame retardant compound) through the outlet and pipe configuration downwardly toward the stove to extinguish the fire.

This and other stove mounted systems are extremely important as a large majority of fires occur on or around a stove. By extinguishing stove fires rapidly most fire damage can be minimized and many fire related deaths and injuries can be avoided.

This system had many advantages over prior art stove top extinguishers including compact size, relatively unobtrusive appearance and ease of installation. Nevertheless, through use it has become apparent that this system has a number of shortcomings.

First, while requiring smaller and fewer components than the prior art, this system is still relatively complex and therefore expensive to manufacture. For example, this system requires at least two interconnected pipes for dispensing retardant material, several cable sections located outside the pipes and connected by fuse links, and a complex connection system for linking the canister to the pipes. In addition, the gas and electricity shut off mechanisms require many different mechanical components which are subject to breakdown.

Second, this system is still difficult to install. When installed the canister is located up and in a back portion of the hood. To install this system the bracket has to be fastened to a rear area of the hood's internal under surface. Where the hood is deep enough to facilitate installation access, to the hood's rear area is difficult. In addition, because the canister outlet must be at a specific angle and location with respect to the pipe system, the bracket must be adjustable and must be adjusted through trial and error during installation.

Third, once installed, this system may not have an appealing appearance. For example, where the internal portion of the hood is not sufficiently deep, the pipe and cable configuration might be readily observable below the front portion of the hood. In addition, the canister may be observable. This is particularly true where the hood is not deep enough to accommodate both the bracket and the canister.

Fourth, this system has some operational constraints. For example, the fuse links and cable sections are generally unprotected and could accidentally break dispensing canister material.

Fifth, after a fuse link breaks, the entire cable and fuse link assembly must be replaced in order to reset the trigger mechanism.

Sixth, part of the trigger mechanism is located outside a protective housing (e.g., pipe or other rigid housing). In this case, if the system is installed in a small area the moving trigger mechanism could be placed adjacent a hood section which might hinder triggering action thus rendering the system ineffective when the link breaks.

Seventh, these systems have many of the shortcomings that are described above in relation to the hand held extinguishers. For example, the high pressure canisters and gauges for these systems are typically expensive. In addition, the canisters are usually heavy so that mounting hardware has to be extensive and these systems have to be routinely maintained.

Thus, it would be advantageous to have a hand held extinguisher which is light weight, relatively inexpensive to manufacture, has a small size and is suitable for use in extinguishing large and small fires. In addition, it would be advantageous to have a mounted and automatic system which is also light weight, inexpensive, small and overcomes the other limitations associated with mounted systems above.

BRIEF SUMMARY OF THE INVENTION

The present invention includes a fire extinguisher which includes a canister having first and second ends with an outlet at the second end, a plunger mounted within the canister for movement from the first toward the second end, a biaser, typically in the form of a spring for biasing the plunger toward the second end and a trigger mechanism which maintains the plunger and biaser in a loaded configuration at the first end until the trigger mechanism is activated. When the trigger mechanism is activated the biaser uncoils forcing the plunger toward the second end and thereby forcing compound inside the canister out the outlet to extinguish the fire.

Thus, one object of the invention is to provide an extinguisher wherein canister pressure is zero during storage. In the present case canister pressure is virtually non-existent as all of the spring pressure is usurped by the trigger mechanism.

Another object is to provide an extinguisher which can be discharged in any orientation including upright, inverted, longitudinal, etc., and which is not affected by gravity. To this end, because the plunger is motivated via a spring instead of a high pressure gas, retardant compound is always adjacent the outlet and is not mixed with gas. Therefore, when the valve is opened, compound is discharged.

One other object is to provide an extinguisher which can be used in extreme temperature environments. With the present extinguisher, because the compound is under virtually zero pressure during storage, the extinguisher can be successfully operated at temperatures as low as 65° F. below zero and 210° F.

Preferably the container is formed of rigid plastic. Another object is to provide a relatively light weight extinguisher. To this end, because the canister need not maintain extremely high pressures over extended periods, the canister can be formed of plastic or some other light weight material, thus reducing the overall weight of the extinguisher.

Also, preferably, the container is at least partially transparent. Yet another object is to eliminate the need for a pressure gauge, thus reducing extinguisher costs. To this end, because extinguisher operation is not related to canister pressure (i.e., is only a function of spring position), no pressure gauge is required. To allow visual inspection of the extinguisher to confirm a loaded state, either the canister can be formed of an transparent plastic or a strip of the canister can be transparent, thus allowing a user to visually determine if the canister is loaded, partially loaded or completely discharged of compound.

Preferably, the extinguisher includes a container forming a material chamber having first and second ends and forming at least one outlet at the second end, a plunger positioned for movement within the container essentially between the first to the second ends, a motivator for selectively moving the plunger through the chamber from the first to the second ends and a seal for the outlet, the seal openable to permit retardant material to pass through the outlet.

In one aspect the motivator includes a biaser for biasing the plunger toward the second end and a trigger linked to the plunger and moveable between at least triggered and untriggered positions, in the untriggered position, the trigger maintaining the plunger in a position within the chamber and in the triggered position, the trigger allowing the biaser to move the plunger toward the second end. Preferably the biaser is a spring.

In one embodiment the trigger includes an elongated engagement member operatively connected to at least one of the plunger and the spring, the engagement member having a plurality of openings, the trigger further comprising a pawl movable into and out of the openings to selectively engage the engagement member and prevent movement of the spring and the plunger.

Thus, another object is to provide an extinguisher which facilitates partial discharge of retardant compound from a storage container. This is accomplished via the rachet and pawl.

In another aspect the extinguisher includes a handle fixed to the container, the handle forming a handle chamber, the engagement member and spring being at least partially positioned in the handle chamber, the pawl extending through the handle so as to be operable by the finger of a user to move the pawl out of engagement with the engagement member to release the plunger. Preferably the pawl is biased for engagement to the engagement member.

In yet another aspect, the engagement member is at least partially coiled within the handle chamber.

In another aspect the extinguisher includes a nozzle insert which causes compound to form a spray when it is discharged from the container. One other object is to provide an extinguisher which provides a "soft touch" extinguisher spray of compound when activated which can put out a fire without causing a fire blast. The nozzle insert accomplishes this.

In another aspect the extinguisher includes means for mounting the container above an area to be monitored, the apparatus also including a heat sensitive trigger which senses ambient temperature and, when the ambient temperature exceeds a maximum value, causes the trigger to assume the triggered position.

In yet another aspect the extinguisher is to be mounted proximate a monitored area and further includes a single rail having a length and an internal wall, the wall forming a rail chamber having first and second ends, the second end forming an opening, the opening and rail chamber formed to receive the container with the second end of the container adjacent the second end of the rail chamber and an end plug receivable in the second end of the rail chamber after the container is positioned inside the rail chamber, the end plug forming a plug channel having first and second ends, the first end formed so as to seal against the outlet of the container, the second end formed so as to be directed at the area to be monitored.

Preferably the rail also forms a retardant guiding channel within the rail wall and at least one rail outlet which is directed at the area to be monitored and the plug channel second end opens into the retardant guiding channel.

Most preferably the guiding channel is formed in the internal surface of the rail internal wall and the guiding channel and an external wall of the container together form a retardant guiding passage.

Thus, another object of the invention is to provide a simple extinguisher for mounting and automatic fire extinguisher. To this end, the inventive mounted extinguisher, like the hand held extinguisher described above and below in greater detail, includes a container for compound which is under no pressure during storage but still provides enough pressure via the spring to extinguish a fire. In addition, this extinguisher can primarily be formed of plastic, requires very few components, may include an entirely internal trigger mechanism and is relatively aesthetic. To enhance aesthetics, in addition to being cylindrical, this extinguisher may also generally have a rectangular, triangular or other cross-sectional shape. These shapes may also allow better placement of the mounted extinguisher.

Other and further aspects and objects of the present invention will become apparent during the course of the following description and by reference to the accompanying drawings.

DETAILED DESCRIPTION OF THE INVENTION

Figure 1:
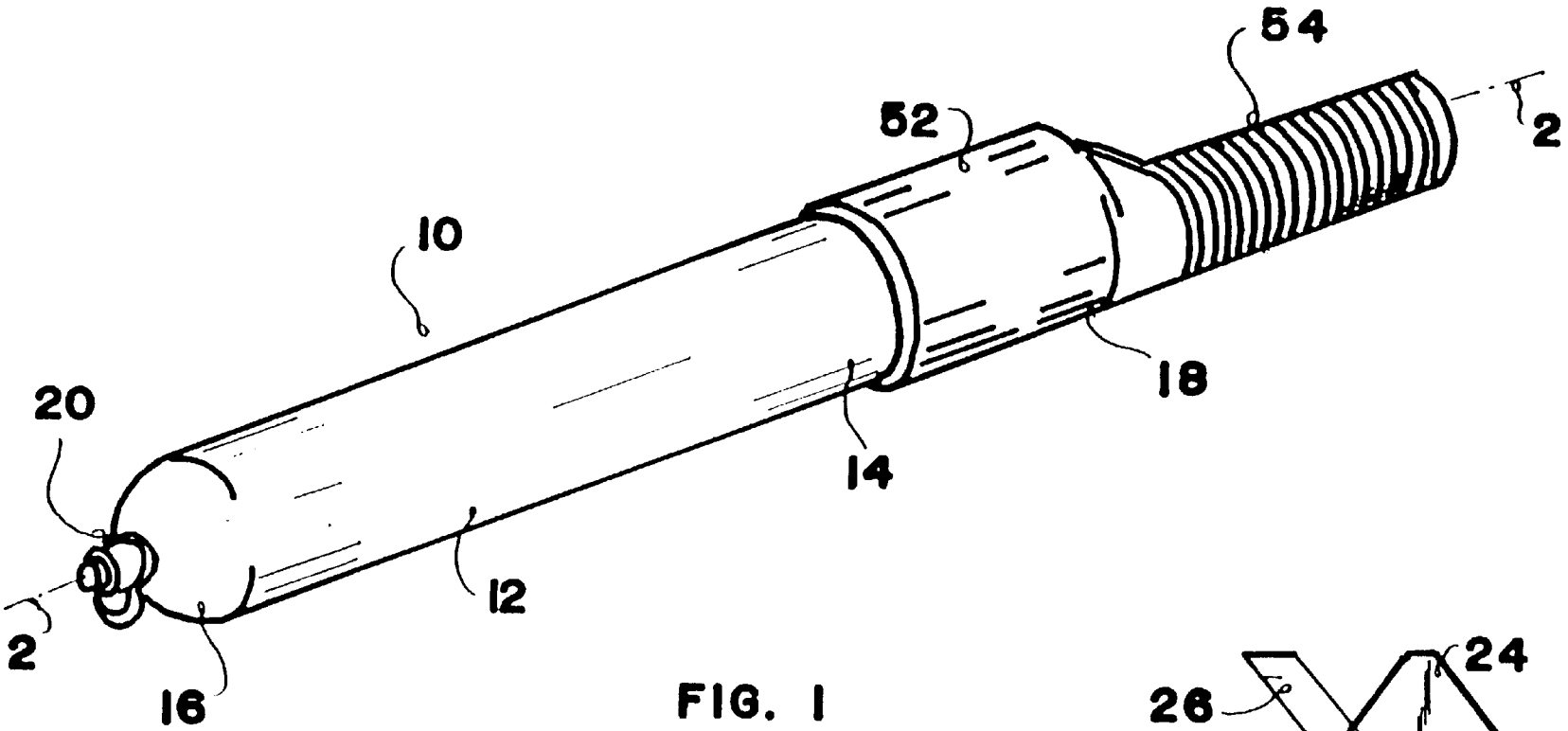
FIG. 1 is a perspective view of an inventive hand-held fire extinguisher.

Referring now to the drawings, wherein like reference characters represent corresponding elements throughout the several views, and more specifically, referring to FIGS. 1 through 4, a first manual and hand-held embodiment of the inventive extinguisher 10 is illustrated. This extinguisher 10 generally includes a tubular and elongated retardant chemical compound container 12 and a handle/trigger assembly 18.

The container 12 has first and second opposite ends 14, 16, respectively. The first end 14 is open and forms a radially outward extending flange 25 adjacent its distal edge 27 about its circumference. The second end 16 is substantially closed and forms a single outlet 20 which opens into a cylindrical nozzle extension 31. Extension 31 has a distal reduced radius end 30. A frangible rubber seal 29 is provided in the outlet 20. Seal 29 is typically closed when there is little pressure inside the container 12 but opens readily when container pressure is increased. Container 12 forms a retardant material chamber 22.

Figure 4:
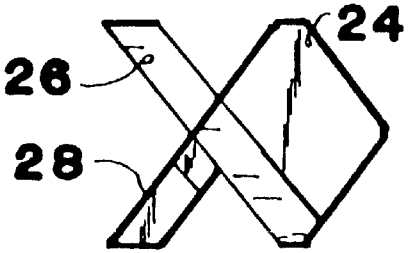
FIG. 4 is a plan view of the nozzle insert of FIG. 2.
Figure 2:
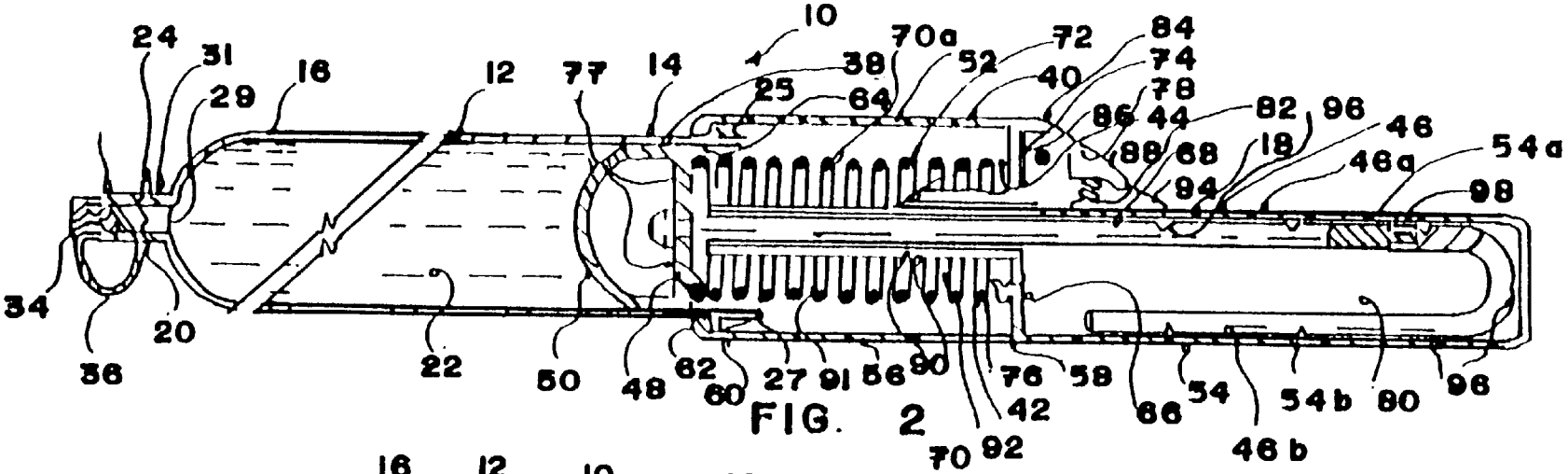
FIG. 2 is a cross sectional view taken along the line 2—2 of FIG. 1 with the extinguisher in a loaded configuration.
Figure 3:
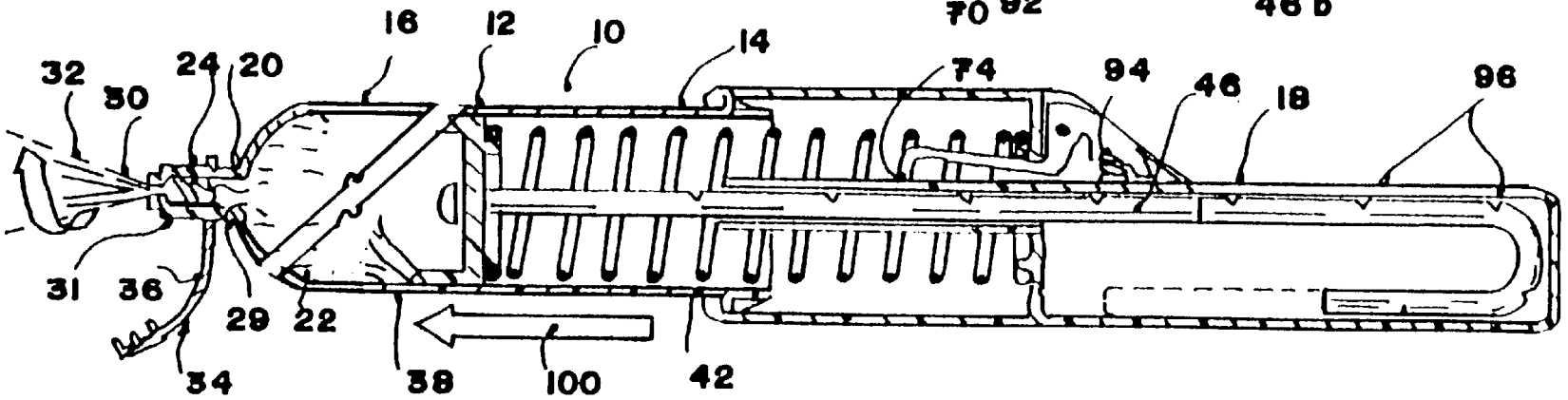
FIG. 3 is similar to FIG. 2, albeit with the extinguisher in a partially discharged configuration.

Referring to FIGS. 2, 3, and 4, an outlet insert 24, typically formed of plastic, metal or some other rigid material, is provided inside outlet 20. Insert 24 is formed of a single piece of material including two armlike members 26 and 28 which are configured in a spiral configuration which tends to increase the velocity of flame retardant material forced therethrough, as will be explained in more detail below. Distal end 30 and insert 24 cooperate to atomize compound forced through outlet 20 and provide a rotating high-velocity spray as illustrated by numeral 32.

A simple plastic cap 34 is provided to close and seal end 30 when extinguisher 10 is not in use. Preferably, cap 34 includes a strap member 36 which connects the cap 34 to container 12 even when the cap 34 is not inserted in end 30.

Referring now to FIGS. 2 and 3, handle/trigger mechanism 18 generally includes a plunger 38, a handle housing 40 and a motivator for selectively moving plunger 38 through chamber 22 from the first end 14 to the second end 16 of container 12. The motivator includes a biasing means, typically in the form of a spring 42, a trigger 44, and an elongated engagement member or extension 46.

Plunger 38 typically takes the form of a piston and includes a base wall 48 and a dome wall 50, and is sized to have a radius which is slightly less than the radius of chamber 22, such that plunger 38 fits snugly within chamber 22. An annular extension 77 is provided on a surface of base wall 40 opposite wall 50 which is sized to be received within one end of spring 42. Plunger 38 should be formed of rubber or a resilient plastic such that it forms a seal around its outer surface with the internal wall of chamber 22. However, the plunger 38 should be formed of a material which has a minimal coefficient of friction with the material that chamber 22 is formed of such that plunger 38 movement within chamber 22 is essentially uninhibited by plunger 38 contact with chamber 22. Handle housing 40 includes a spring housing section 52 and an extension housing section 54. Section 52 is essentially cylindrical, having a radial wall 56 with first and second ends 58, 60, respectively. At the second end 60, a radially inward flange 62 is provided which forms an aperture 64 having a diameter which is slightly greater than the diameter of the outer surface of container 12 but is less than the diameter of flange 25 extending off container 12. At the first end 58, another radially inward flange 66 is provided. Flange 66, however, extends inwardly much further than flange 62, forming a reduced diameter opening 68 which is concentric with opening 64.

An internal cylinder 70 is provided at opening 68 and extends from first end 58 substantially to second end 60 forming an internal cylinder channel 72 which is concentric with openings 64. Cylinder 70 is open at both ends. A single aperture 74 is provided in cylinder 70 approximately one third or one half way along its length on a trigger side 70*a* of cylinder 70. In addition to cylinder 70, an annular flange 76 extends from flange 66 toward second end 60. Flange 76 is approximately the same size as flange 77 so that it is suitable to receive one end of spring 42.

An aperture 78 is provided in flange 66 between flange 76 and cylinder 70 which is aligned with aperture 74 (i.e. is at the same radial position.)

Housing section 54 preferably has a reduced radius when compared to section 52. Section 54 extends from section 52 forming a hollow cylinder about an internal chamber 80. Section 54 is not concentric with section 52, but instead includes a cylinder having opposite sections 54*a* and 54*b* which define a diameter therebetween which extends from trigger side 70*a* of cylinder 70 which is aligned with section 54*a* across channel 72 to a distal section of section 52 which is aligned with section 54*b*. Thus, the axis about which apertures 64 and 68 are formed extends into chamber 80 and is relatively closer to section 54*a* than it is to section 54*b*. Section 54*a* forms an annular extension 82 near flange 66 which is radially aligned with apertures 74 and 78. (i.e. is at the same radial position.)

Two walls 84 (only one is shown) extend from flange 66 to section 54*a* and form a trigger channel therebetween. A post 86 is provided between the two walls 84 which supports trigger 44 as will be described below.

Trigger 44 includes a button section 88 and an extension 90 having a pawl 91 at its distal end. Trigger 44 also forms an annular extension 92 which is substantially identical to annular extension 82. A second spring 94 which is much smaller than spring 42 is provided.

Extension 46 is essentially an elongated ratchet assembly having recesses collectively referred to by the numeral 96 which are equi-spaced along its length. In the embodiment illustrated, extension 46 includes two separate sections, a rigid section 46*a* and a deformable section 46*b*, which are connected via a link 98.

When assembled, trigger 44 is mounted on post 86 with spring 94 between extensions 82 and 92 and pawl 91 aligned with aperture 74. The spring forces section 88 outwardly and forces pawl 91 through aperture 74 when section 88 is not depressed. Extension 46 is centrally connected to the base wall 48 of plunger 38 in any manner known in the art. Spring 42 is placed so that one end is around flange 76, and the length of the spring is around cylinder 70. Extension 46 is placed through channel 72 such that the free end of spring 42 receives flange 77. The spring 42 is compressed while plunger 38 is forced toward housing 40. As spring 42 is compressed, section 46*b* is forced into chamber 80 and curls up therein as illustrated. In addition, as spring 42 is compressed, extension 46 will force pawl 91 out of channel 72 unless pawl 91 is aligned with one of the recesses 96. When the pawl 91 is aligned with a recess 96, pawl 91 extends into the recess and effectively "locks" the extension 46 in its instantaneous position unless a user purposefully causes pawl 91 to be removed from the recess 96 by either pushing on section 88 or forcing the plunger 38 to further compress spring 42. Plunger 38 is forced toward housing 40 until pawl 91 is aligned with and extends into the recess 96 closest to plunger 38.

To connect container 12 to housing 40, container 12 is configured such that container 12 extends through aperture 64 with flanges 25 and 62 interlocked as illustrated. In this configuration, outlet 20 is at one end of the extinguisher and handle housing 54 (i.e. a handle) is at an opposite end (see FIG. 1).

With the extinguisher assembled as described above, cap 34 is removed from distal outlet end 30 and chamber 22 is filled via outlet 20 with a flame retardant chemical compound. Once filled, cap 34 is positioned so as to block end 30.

In operation, when the extinguisher 10 is to be used to put out a fire, a user picks up the extinguisher 10 via handle section 54 with a thumb or finger placed over section 88. Cap 34 is removed from end 30. Moving to an area within the vicinity of the fire, the user holds out his or her arm and points end 30 directly at the base of the fire. The user pushes on section 88 causing spring 94 to contract. When spring 94 contracts, pawl 91 is removed from recess 96. (See FIG. 3.) When pawl 91 is removed from recess 96, pawl 91 no longer locks extension 46 in its instantaneous orientation. Spring 42 begins to expand forcing plunger 38 from the first end 14 in a direction toward the second end 16 as illustrated by arrow 100. When plunger 38 is moved, pressure inside chamber 22 instantaneously increases forcing seal 29 to open (see FIG. 3) so that retardant compound is forced therethrough. The compound is forced through insert 48 and then out distal end 30 forming spray 32.

Where a user only wants a small amount of retardant compound to be forced out of chamber 22, the user can simply depress section 88 for a short time. When section 88 is depressed for a short time, spring 94 contracts, pawl 91 is removed from recess 96 and spring 42, plunger 38 and extension 46 begin to move as illustrated in FIG. 3. However, immediately after section 88 is released, pawl 91 is forced through aperture 74 and will be forced via spring 94 back into channel 72 again once the next aperture 96 is aligned therewith. Thus, by depressing and immediately releasing section 88, the spring 42 will only be allowed to expand until the next recess 96 is aligned with pawl 91.

Where the user wishes to discharge all of the compound in chamber 22, the user can simply hold down section 88 for an extended period allowing spring 42 to expand until plunger 38 has reached end 16.

Importantly, when retardant compound is placed inside chamber 22, the compound is under virtually no pressure until the extinguisher 10 is activated. All spring pressure is sustained by extension 46 and pawl 91. Therefore, container 12 can be formed of a relatively inexpensive and light material, such as plastic. In addition, because container 12 can be formed of plastic, the container can be formed of a transparent plastic so that a user can immediately visually determine whether or not the extinguisher 10 is fully charged, partially charged, or completely discharged. For this reason, the present extinguisher does not require a pressure gauge to identify whether or not it is charged.

Referring now to FIGS. 5 through 8, a second handheld and manually-operated extinguisher 110 is illustrated. This embodiment is similar to the embodiment illustrated in FIGS. 1–4, in that it relies on spring pressure and a plunger as opposed to high pressure flame retardant material to discharge retardant compound. The extinguisher 110 includes a housing 112, a material canister 114, a handle/trigger assembly 116, a plunger, a discharge hose 120, and various other components which will be described in more detail below.

The housing 112 includes first and second sections 112*a* and 112*b*. The first section 112*a* includes a half cylinder wall 123 and a bottom circular floor member 122. There is a channel 124 formed in section 112*a* which has a first end 126 concentrically positioned in member 122, and a second end 127 at wall edge 128. Annular fittings 132 and 134 are provided, one at each of the first and second ends 126, 127, respectively. Second section 112*b* consists of a wall which is substantially identical to wall 123 except that it does not form a channel therethrough and does form an elongated hose storage recess 137 along its length. Sections 112*a* and 112*b* also form connecting mechanisms (not identified by numbers) which allow the two sections 112*a* and 112*b* to be securely connected together forming a housing cylinder as illustrated in the figures.

Canister 114 is a cylindrical canister which forms a compound chamber 172. Canister 114 is formed so that it will fit snugly within the space defined by sections 112*a* and 112*b* when the sections 112*a* and 112*b* are connected to each other. Canister 114 forms a central outlet 138 in its lower wall 140 which has an elastomeric O-ring 142 positioned therein. Outlet 138 is formed so that when canister 114 is positioned in housing 112, the outlet 138 receives fitting 132 and the O-ring 142 forms a seal therebetween. Canister 114 has first and second ends 143, 144, respectively. Canister 114 is essentially open at its first end 143.

Figure 6:
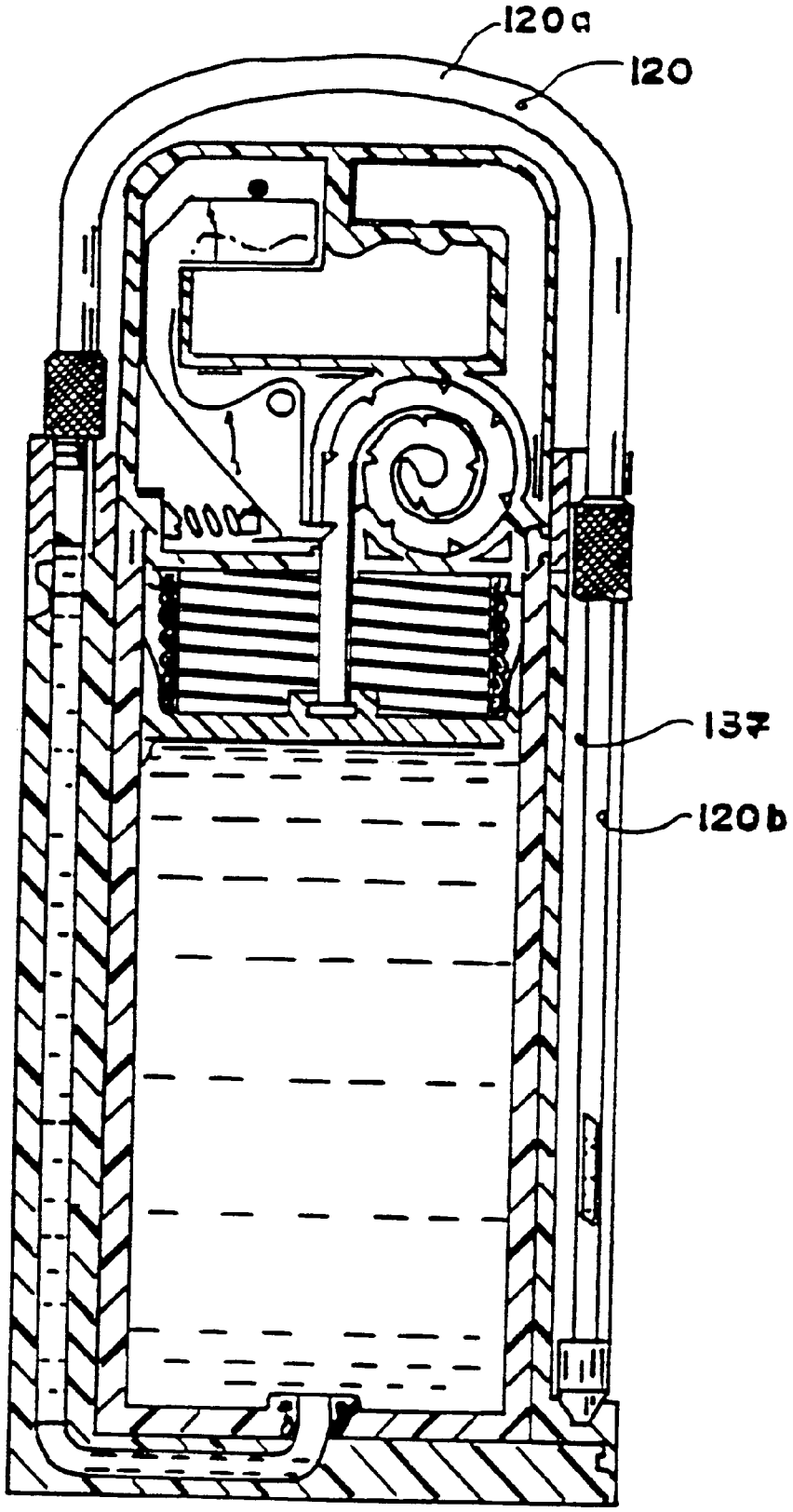
FIG. 6 is a cross sectional view of the extinguisher of FIG. 5 in a fully loaded configuration.
Figure 7:
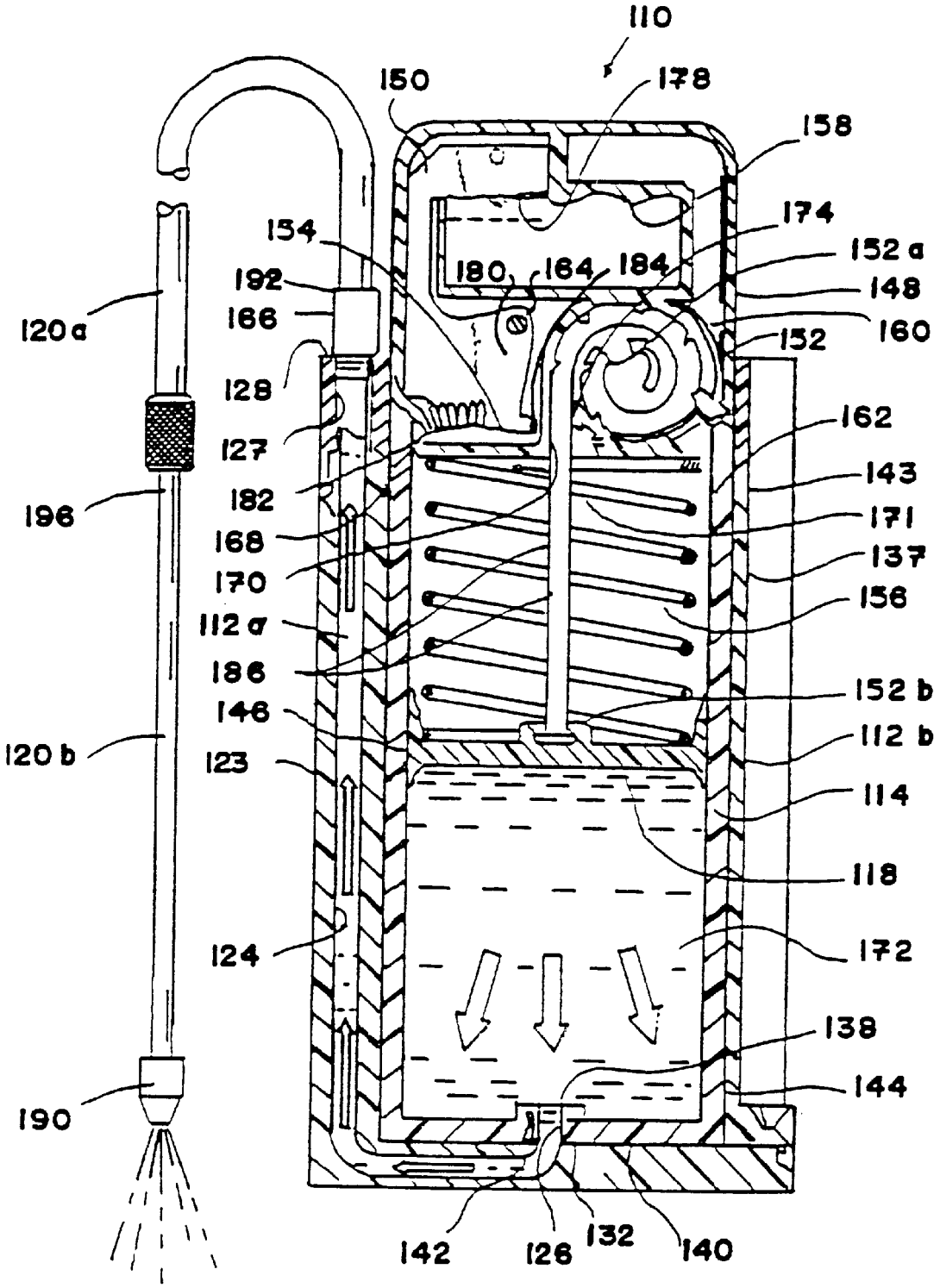
FIG. 7 is a view similar to FIG. 6, albeit with the extinguisher in a partially discharged configuration.

Referring still to FIGS. 6 and 7, plunger 118 in this embodiment includes a single wall which is formed such that, when placed inside canister 114, the lateral edges 146 form a seal with the internal surface of canister 114. As in the first embodiment, in this embodiment, plunger 118 should be formed of a rubber or resilient plastic which has a relatively low coefficient of friction with the material that canister 114 is formed out of so that plunger 118 can move between the first and second ends 143 and 144 of canister 114 uninhibited by contact therewith.

Handle/trigger assembly 116 includes a housing section 148, a trigger 150, an extension 152, a spring 154 and a relatively larger spring 156. Housing 148 has an upper section which forms a handle 158 and a lower section which forms an extension housing 160 having a tangent channel 171 and a lower, substantially circular, base wall 162. In addition, housing 148 forms a post 164 on which trigger 150 is mounted, an annular extension 166 for receiving spring 154 and an axially-extending annular flange 168 which extends downwardly from wall 162 for receiving spring 156.

An aperture 170 is provided centrally within wall 162 and provides a pathway between channel 171 and chamber 172. An aperture 174 is provided in channel 171.

Figure 5:
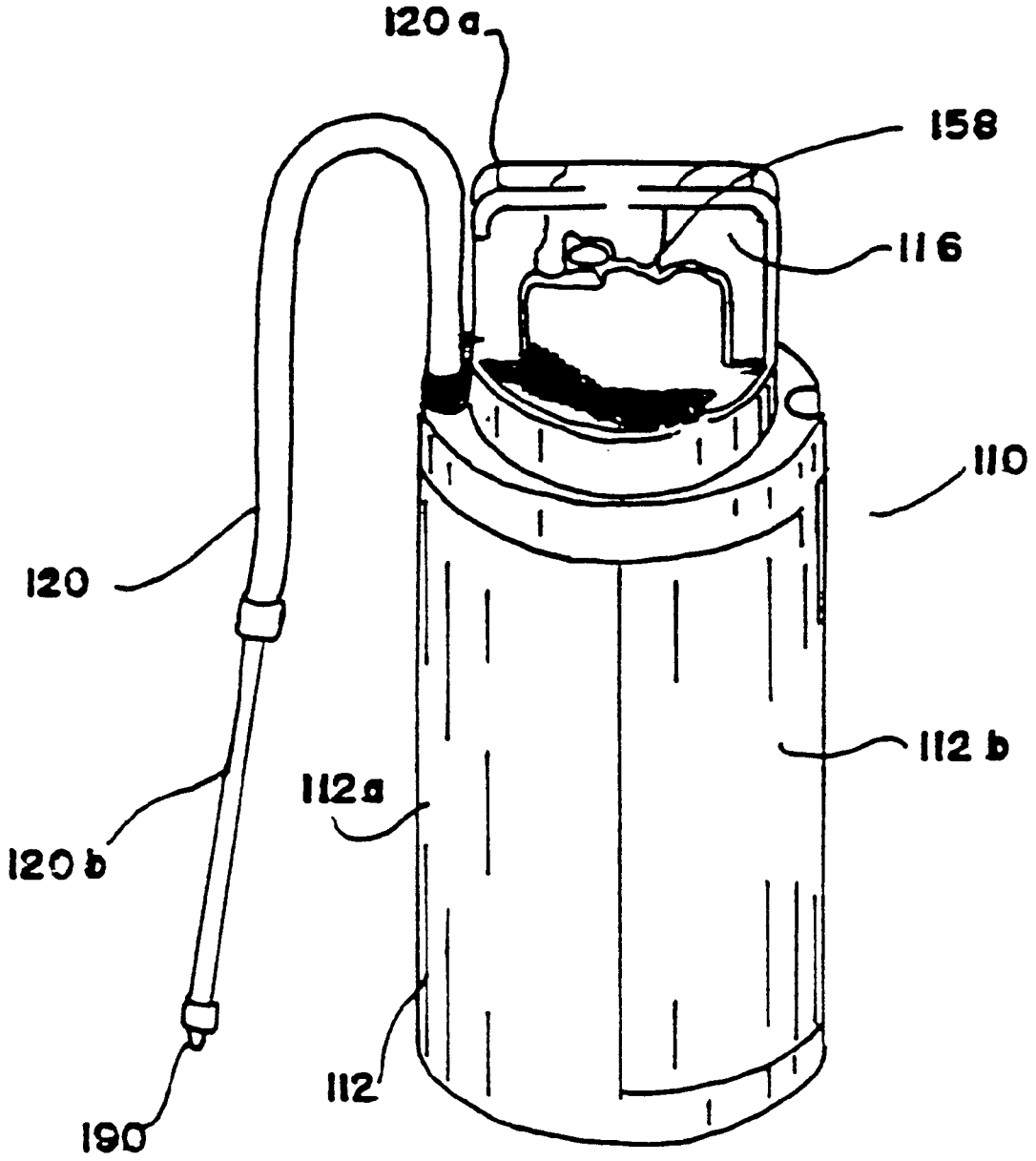
FIG. 5 is a perspective view of the second hand-held extinguisher embodiment.

Referring to FIGS. 5, 6 and 7, trigger 150 includes a trigger section 178, an extension 180, an annular extension 182 for receiving and supporting spring 154 and a pawl 184 at the distal end of extension 180. The trigger 150 is mounted on post 164 such that section 178 is adjacent handle 158 and can be easily depressed thereat. In addition, the trigger 150 is mounted such that pawl 184 is forced via spring 154 though aperture 174 into channel 171 when section 178 is not depressed.

In this embodiment, extension 152 consists of a single deformable and resilient element which curls up in chamber 160 as illustrated in FIGS. 6 and 7 when spring 156 is compressed but which can also assume an elongated configuration when spring 156 expands. Extension 152 includes a plurality of recesses equispaced along its length which are collectively identified by numeral 186. A first end 152*a* on extension 152 is not connected but a second end 152*b* is securely connected to plunger 118.

Discharge hose 120 includes a deformable section 120*a* and a rigid wand section 120*b* at the end thereof. The two sections 120*a* and 120*b* can be used by an operator to direct a nozzle end 190 of the hose 120 toward the base of a fire. The end of the hose opposite the nozzle end 190 includes a fitting which is suitable for connection to fitting 134.

When assembled, trigger 150 is mounted on post 164 with spring 154 between extensions 166 and 182 such that pawl 184 is forced via spring 154 through aperture 174 and into channel 171. End 154*b* is connected to plunger 118. Spring 156 is received by flange 168 so that one end of spring 156 rests on wall 162. Extension 152 is inserted through spring 156 and through channel 171. Extension 152 and plunger 118 are forced toward housing 148 compressing spring 156 while extension end 152*a* curls up inside housing 160. As end 152*a* is forced into housing 160, pawl 184 is periodically received in recesses 186 which cooperate to lock the extension 152 in its instantaneous configuration. Eventually, the recess 186 closest to plunger 118 is aligned with pawl 184 and pawl 184 is received therein locking the plunger 118, spring 156 and extension 152 in a loaded and untriggered configuration.

Next, chamber 172 is approximately ⅘ths filled with retardant compound (assuming spring 156 and plunger 118 require approximately ⅕th of the space inside canister 114). If desired, canister 114 can be slightly over filled so that when assembly 116 is forced onto the first end 143 of the canister, some of the compound therein is forced into hose 120. In this case, when the extinguisher 110 is activated, discharge will be immediate. Assembly 116 is secured to the first end 143 of canister 114 with plunger 118 near the first end and at the top of the compound chamber 172.

With assembly 116 securely attached to canister 114, the canister is placed over fitting 132 and seal 142 forms a liquid tight seal between fitting 132 and outlet 138. Wall 112*b* is then connected to section 112*a* so that the housing 112 completely surrounds canister 114.

Figure 8:
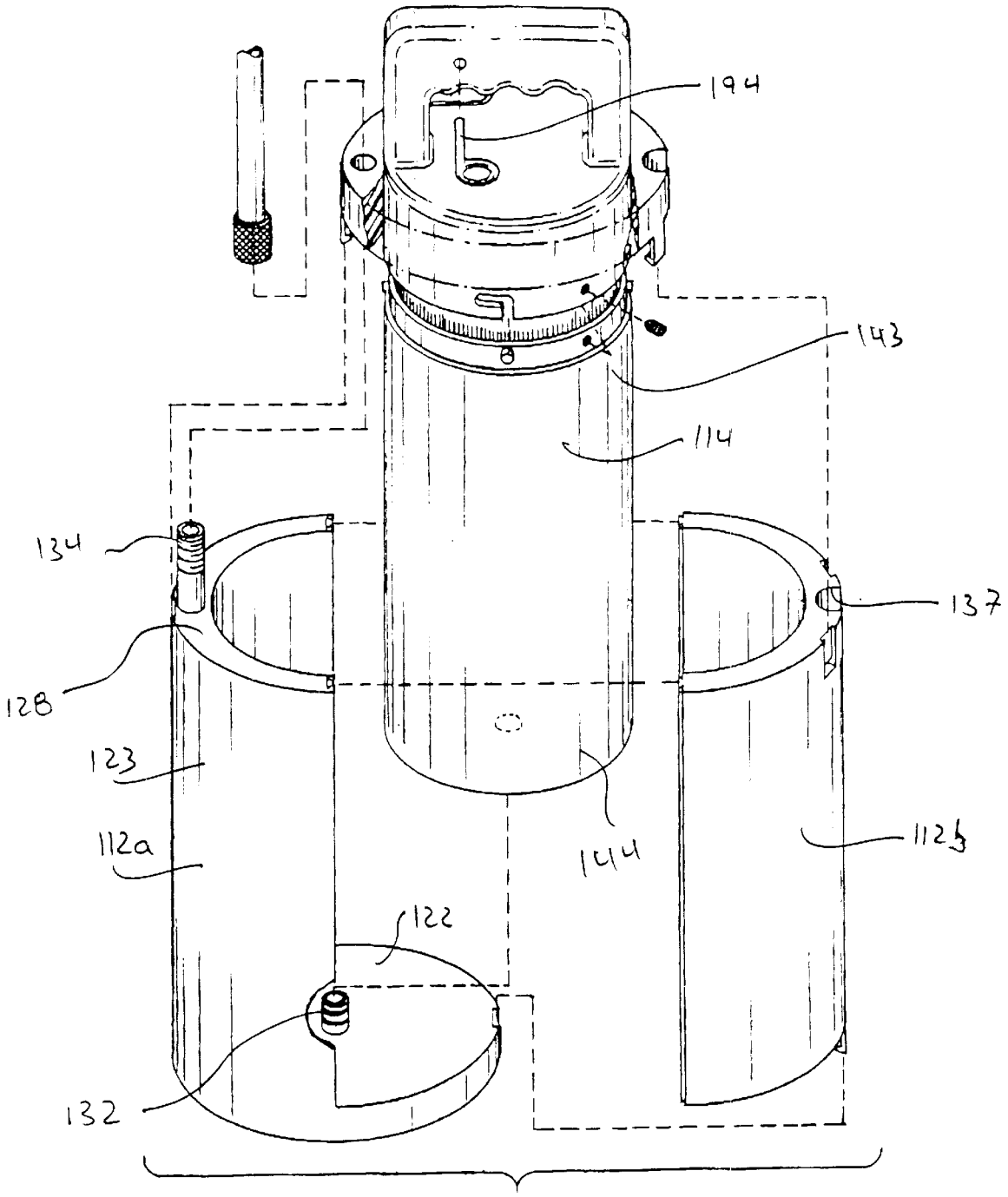
FIG. 8 is a partially exploded view of the extinguisher of FIG. 5.

Fitting 192 is connected to fitting 134 and wand 120*b* is secured in channel 137 via a pressure fitting or the like (see FIG. 6). Referring to FIGS. 5 and 8, a pin 194 is provided and apertures are provided in handle 158 and trigger 150. The apertures align when trigger 150 is in an untriggered configuration and pin 194 can be inserted therethrough to ensure that trigger 150 is not triggered inadvertently when extinguisher 110 is being transported.

In operation, when a fire occurs, a user transports extinguisher 110 to an area proximate the fire by picking up the extinguisher via handle 158. When proximate the fire, the user removes pin 194 from handle 158, freeing trigger 150 so that section 178 can be depressed. The user removes wand 120*b* from channel 137. Holding wand 120*b* at an end 196 opposite nozzle end 190, the user directs nozzle 190 at the base of the fire. The user depresses section 178. When section 178 is depressed, trigger 150 rotates about post 164 against the force of spring 154 causing pawl 184 to be removed from recess 186 and channel 171. When pawl 184 is removed from recess 186, spring 156 and plunger 118 are no longer locked in a single configuration. At this point, spring 156 begins to expand, forcing plunger 118 toward second end 144 of canister 114. The plunger 118 in turn forces retardant compound from inside chamber 172 into channel 124 and through hose 120 and nozzle 190 toward the fire.

Again, if the user only wishes to discharge a small amount of material from chamber 172, the user can depress section 178 for a short time. In this case, pawl 184 is removed from recess 186, spring 156 begins to expand extending extension 152 such that pawl 184 is no longer aligned with one of the recesses 186. However, when section 178 is released, pawl 184 is forced against extension 152 and, when the next recess 186 becomes aligned with pawl 184, pawl 184 is forced into the recess 186 once again locking extension 152, spring 156 and plunger 118 in a single configuration until section 178 is again depressed.

In addition, as with the first embodiment, with this embodiment, if a user intends to discharge all of the compound in chamber 172, the user simply depresses section 178 for a long period enabling spring 156 to expand until plunger 118 reaches end 144.

Referring now to FIGS. 9–12, there is illustrated yet another embodiment 250 of the inventive fire extinguisher system. This embodiment, unlike the first two is meant to be mounted in a ceiling, stove hood or the like. In addition, this embodiment is different in that it is meant to be an automatic as opposed to a manual extinguisher. In this embodiment 250, instead of providing a single canister 12 which must be connected to rail 14, two canisters are provided inside an extruded rail. This embodiment includes a rail 252 and two canisters 254 and 256 in addition to other components which will be described in more detail below.

Figure 10:
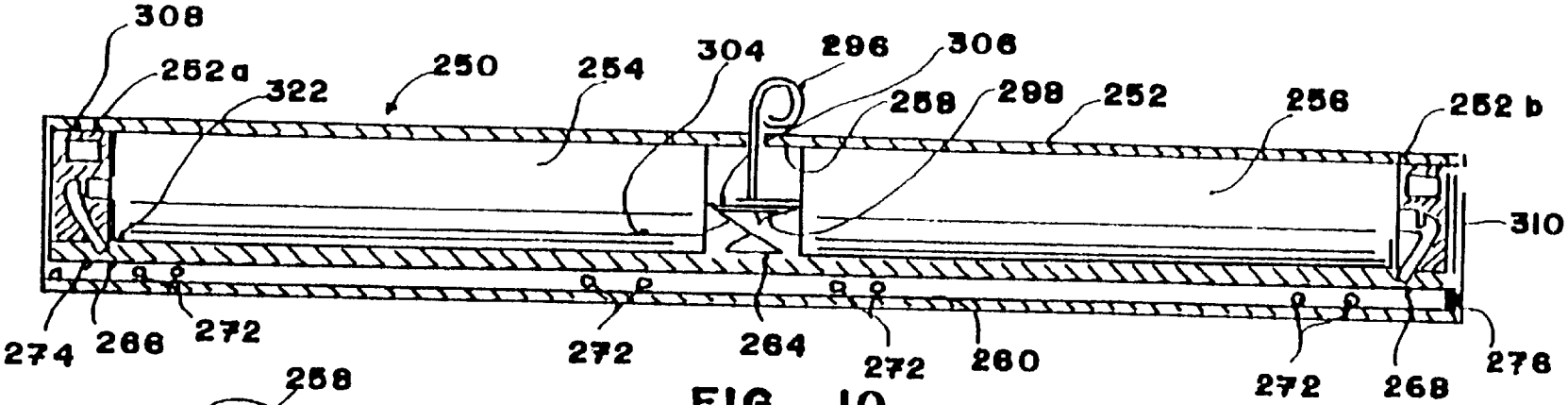
FIG. 10 is a cross sectional view taken along a line 10—10 of FIG. 9.
Figures 11, 12:
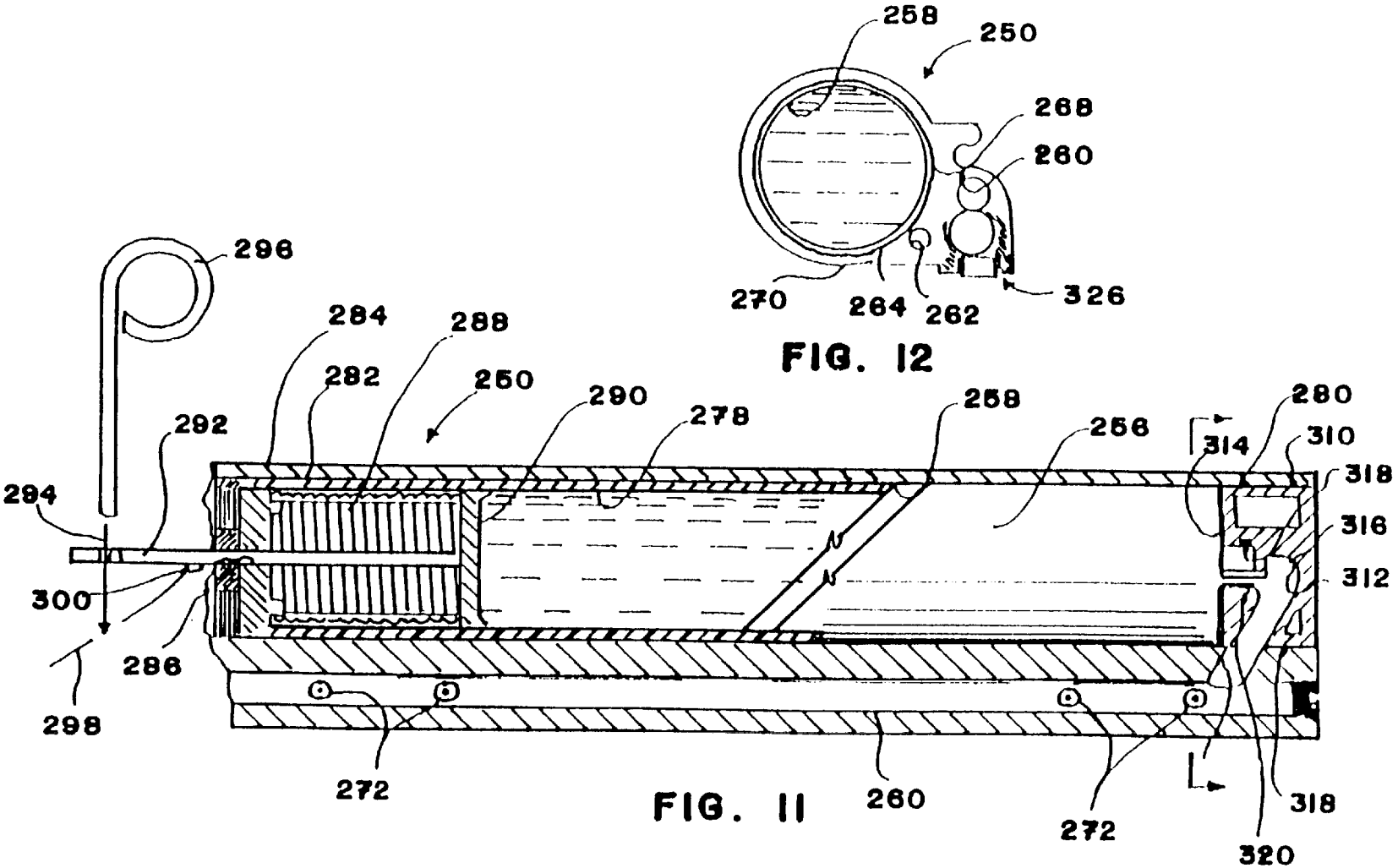
FIG. 11 is similar to FIG. 10 except that it is a partial view.
FIG. 12 is a cross sectional view taken along the line 12—12 in FIG. 10.

Referring to FIGS. 10, 11 and 12, the rail 252 is an elongated extruded member, preferably of aluminum, having first 252*a* and second 252*b* ends. Rail 252 forms three channels including a canister channel 258, a retardant guiding channel 260 and a cable channel 262. Channel 258 has a relatively large radius so that it can accommodate canisters 254 and 256. In the middle of rail 252, the rail 252 forms an opening 264 (see FIG. 17) between channels 258 and 262. In addition, rail 252 forms two openings 266, 268 between channels 258 and 260, opening 266 formed at end 252*a* and opening 268 formed at end 252*b*.

Rail 252 generally has a lower surface 270 and forms a plurality of discharge outlets collectively referred to by the numeral 272 in surface 270. Outlets 272 extend through surface 270 into channel 260. The ends 274, 276 of channel 260 are threaded.

Each of the two canisters 254, 256 is constructed in and functions in substantially the same manner and therefore only canister 256 will be described in detail. Referring specifically to FIG. 11, canister 256 includes a shell 278 with an outlet end 280 and a spring loaded end 282. A threaded cap 284 closes the spring loaded end and forms a central opening 286. A plunger 290 and a spring 288 are positioned inside shell 278 adjacent cap 284. A plunger extension 292 extends through the central portion of the spring 288 and out opening 286. The extension forms an aperture 294 perpendicular to its length.

Prior to discharge the plunger 290 is forced into a position wherein spring 288 is completely compressed and extension 292 extends out of opening 286. In this position, there is a large area within canister 256 where flame retardant material is stored. Prior to discharge, the extension 292 and associated plunger 290 are held in the spring compressed configuration by both a pin 296 and a cable 298. The pin 296 extends through aperture 294 while the cable 298 is connected to the extension 292 via an eyelet 300.

Referring still to FIGS. 9 through 12 the cable 298 extends through opening 264 into channel 262, extends out of channel 262 (see FIG. 9) and is connected to one-half of a fuse link 302. The other half of link 302 is connected to another cable 304 which extends to the opposite end of channel 262, enters channel 262 and extends there along to opening 264 and is connected to an extension 306 associate with canister 254 (see FIG. 10).

Referring to FIGS. 10 and 11, two end plugs 308 and 310 are provided, a separate end plug 308 or 310 closing each end of channel 258. Both end plugs are substantially identical and therefore only one of the two end plugs 310 will be described here in detail. Plug 310 includes an internal end 314, an external end 316 and an external surface 318 which, when plug 310 is received in the end of channel 258 forms a tight seal with the internal surface of channel 258. Plug 310 also forms a channel 312 which has an inlet end centrally located in end 314 and has an outlet in its circumferential surface 318 (i.e. channel 312 bends from its inlet to its outlet ends). The internal surface of channel 312 forms a circumferential recess 318 adjacent its input end. When assembled, an elastomeric seal 320 is provided in recess 318 and the input end of channel 312 receives the outlet end 280 of canister 256. In addition, when assembled, the outlet end of channel 312 should be aligned with outlet 268. The plugs 308 and 310 can be secured in the ends of channel 258 in any manner known in the art including threading, glue, or some other mechanical means.

In addition to the components discussed above, this embodiment should include some type of mounting mechanism (not shown) to maintain the rail/canister assembly 250 above an area to be monitored. The system also includes two threaded end plugs 322, 324 that are securely received in threaded channel ends 274, 276 and a plurality bolt/nozzle assemblies 326 (see FIG. 12), one assembly for each discharge outlet 272.

Figure 9:
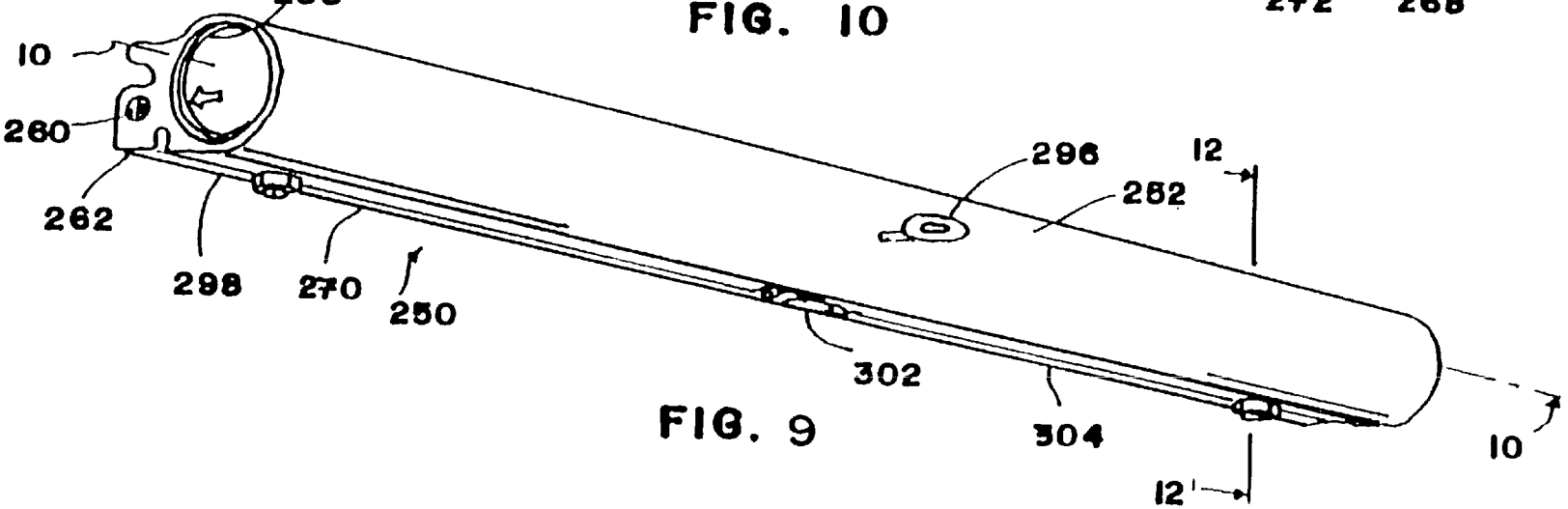
FIG. 9 is a perspective view of a third embodiment of the present invention.

Referring to FIGS. 9 and 10, when installing this embodiment, pin 296 should remain in the position illustrated so that the canisters 254, 256 do not accidentally discharge. After the assembly 250 has been installed above a stove or some other area to be monitored, the pin 296 can be removed so that all of the tension in spring 288 (and the other spring in canister 254) stretches cables 298 and 304 with fuse link 302 therebetween.

In operation, during a fire the excessive heat from the fire will cause link 302 to explode releasing the tension on cables 298 and 304. At this point the springs in canisters 254 and 256 (i.e. spring 288 in FIG. 11) expand forcing associated plungers 290 away from cap 284. Retardant material in canisters 254, 256 then is discharged through outlets (280) and channels (312) into channel 260 and out outlets 272 to extinguish the fire.

Importantly, with the embodiment shown in FIGS. 9 through 12, if the rail 252 is formed of a relatively inexpensive extruded material, this entire system may be disposable after use so that the system would simply be replaced after discharge. This would eliminate the need for a user to determine how to recharge and reset the system.

Figure 13:
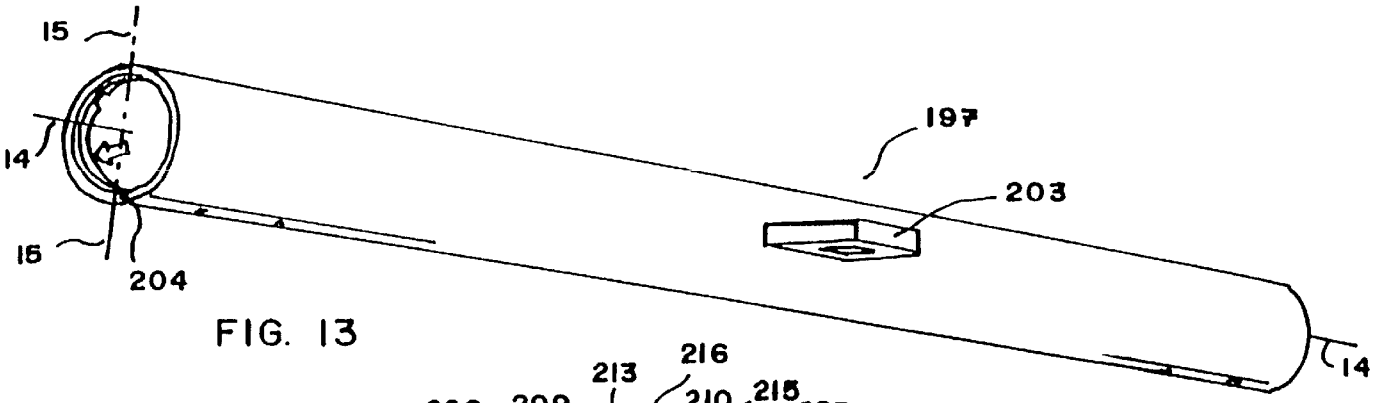
FIG. 13 is a perspective view of a fourth embodiment of the present invention.
Figure 14:
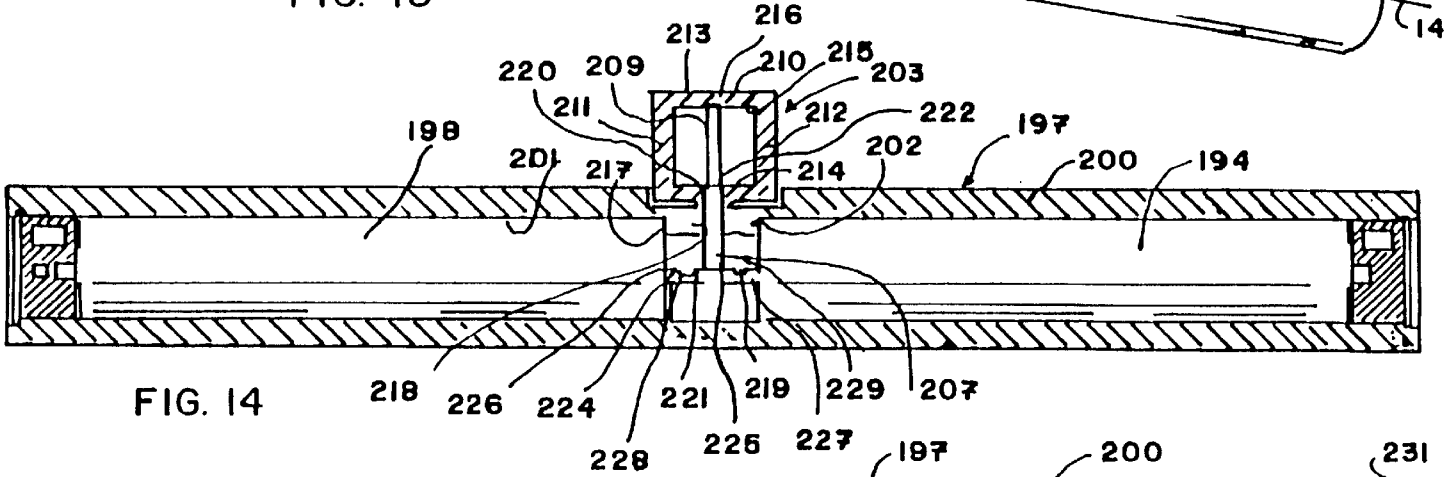
FIG. 14 is a cross sectional view taken along the line 14—14 of FIG. 13.
Figure 15:
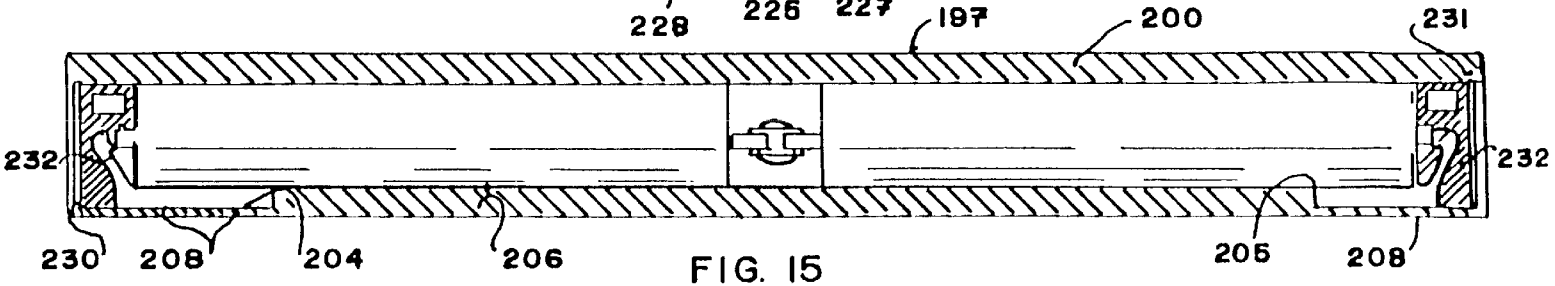
FIG. 15 is a cross sectional view taken along the line 15—15 of FIG. 13.

Referring now to FIGS. 13, 14 and 15, a fourth embodiment 197 of the present invention is illustrated. This extinguisher 197, like the one described in the third embodiment above, is meant to be mounted in a ceiling or a stove hood and is meant to be automatic as opposed to manual. This extinguisher 197 includes a rail 200, two canisters 198, 199, two end plugs 230, 231, a heat sensitive fuse assembly 203 and a C-clamp 224. The internal components of canisters 198 and 199 are substantially identical to the internal components of the canisters in the third embodiment and therefore they will not be described again here in detail.

Rail 200 forms an internal surface 206 which defines a single channel 201 having a radius such that when a canister 198 or 199 is positioned therein, the canister is tightly received within the channel 201. In addition, rail 200 forms a flange 202 of increased thickness at its midsection on one side and forms an aperture 207 through the central portion of flange 202. This flange 202 is provided as a connection area for fuse assembly 203.

In addition, referring specifically to FIG. 15, internal surface 206 also defines two retardant guiding channels 204 and 205. Each channel 204 and 205 extends from one of the rail ends toward the other rail end along a short section of rail length (e.g. three to five inches). In the embodiment illustrated, two apertures are provided through rail 200 within each channel 204 and 205 for a total of four apertures. The apertures are collectively identified by the numeral 208. Also, preferably, nozzles like those illustrated in FIG. 12 are provided, one nozzle for each of the separate apertures 208 so that material flowing therethrough can be directed in specific directions.

Referring to FIGS. 13 and 14, fuse assembly 203 includes a heat sensitive link 209 mounted in a link housing 210. Link 209 explodes when an ambient temperature there around reaches a predetermined threshold value. Housing 210 has two lateral walls (i.e., posts) 211, 212 and upper and lower walls 213, 214, respectively. An internal surface 215 of wall 213 forms a pressure receiving surface configured as a centrally located recess 216. A body member or coupler 217 is integrally connected to housing 210 extending below wall 214. The coupler 217 is configured so that it can be securely and tightly received within aperture 207 (e.g., via threads, a snap ring, welding, crimping, or some other process known in the art). Coupler 217 forms a channel 218 which extends from an internal surface of lower wall 214 down through coupler 217.

A linker in the form of a trigger rod 219 is positioned within channel 218 and has proximal and distal ends 220, 221, respectively. Proximal end 220 forms a second fuse receiving surface in the form of a recess 222 similar to recess 216. Link 209 is receivable between recesses 216 and 222 and, when installed is under extreme pressure therebetween. When so received, distal end 221 extends below coupler 217.

C-clamp 224 includes two parallel legs and a back member which connects ends of the legs and traverses the distance there between. A recess 225 is formed in the midsection of the back member.

Extensions 226 and 227 which extend from canisters 198 and 199 are wider than the extensions 292 in the third embodiment. In addition, these extensions 226 and 227 each form a recess 228, 229, respectively.

Referring now to FIG. 15, end caps 230 and 231 like the end caps illustrated in FIG. 10, each form a channel 232, 233, respectively, which, when assembled, receives at one end an outlet of an adjacent canister 198 or 199. Each channel 232, 233 includes a bend typically of 90° or greater so that the opposite ends open radially as opposed to axially.

When installed properly, channels 232 and 233 should open into channels 204 and 205 when the end plugs 230 and 231 are secured in opposite ends of rail 200.

When assembled, the canisters 198 and 199 are positioned inside channel 201 with their extension 226 and 227 extending below flange 202. C-clamp 224 is forced down such that each of its two distilled ends is received in a separate one of the recesses 228, 229. In this position, when pressure is applied to C-clamp 224 within recess 225, the C-clamp 224 maintains extensions 226 and 227 in a locked positions. With C-clamp 224 so positioned, fuse assembly 203 is securely attached in aperture 207 such that distalled end 221 of rod 219 is received in recess 225 and applies pressure thereto. Next, end caps 230 and 231 are secured in the ends of rail 200 in any manner known in the art such that canister outlets are received in channels 232 and 233 and the opposite ends of those channels open into channels 204 and 205.

After extinguisher 197 is assembled as described above, the extinguisher can then be mounted in any manner known in the art above an area to be monitored and, if nozzles have been provided in outlets 208, the nozzles can be arranged such that they are directed at specifically fire prone areas. When so mounted, fuse assembly 203 should be substantially horizontal (see FIG. 13) such that heat rising from the area being monitored surrounds link 209.

When a fire occurs, heat from the fire rises and surrounds link 209. When the heat exceeds a threshold level required to burst link 209, link 209 is destroyed. At this point, rod 219 is no longer forced downwardly into recess 225 and therefore rod 219 rises up into link housing 210. In response to movement of rod 219, C-clamp 224 is also released which allows extensions 226 and 227 to be moved via springs (not illustrated) inside canisters 198 and 199. Retardant compound inside canisters 198 and 199 is forced via plungers through the canister outlets into channels 232 and 233, into channels 204 and 205 and out of rail 200 via outlets 208.

Thus, it should be appreciated that a simple, reliable and inexpensive extinguisher has been described which is lightweight, can be formed in many different shapes, does not require a pressure gauge, can be operated in any orientation and independent of gravity, can be partially discharged, provides a "soft touch" spray and can be mounted for automatic use or hand operated manually.

It should be understood that the apparatuses described above are only exemplary and do not limit the scope of the invention, and that various modifications could be made by those skilled in the art that would fall under the scope of the invention. For example, while the hand-held manual extinguishers are described as having an extension member with a plurality of recesses so that less than all extinguisher compound can be discharged when desired, clearly the present invention will include a system wherein such metered amounts could not be discharged and wherein all canister content must be discharged at once. In addition, the invention also includes systems wherein the rachet extension member would include a single rigid piece of material. Moreover, while not shown, the automatic extinguisher systems could include a mechanism whereby, when a fire is detected, the system also triggers an alarm indicating that a fire has occurred. Furthermore, while all of the preferred embodiments have been illustrated as having circular plungers and cylindrical canisters or containers holding retardant compound, clearly the present invention should not be so limited and should, instead, include all embodiments having different shapes and sizes of plungers and canisters. For example, the plungers and canisters could be rectangular, triangular, polygonal, etc. In fact, in many applications it may be desirable to have a noncylindrical shaped extinguisher (e.g., in the hood of a stove, on the ceiling in a room, etc.). Moreover, while two automatic triggering mechanisms have been illustrate above, clearly any type of automatic triggering mechanism could be used with the present invention. In addition the inventive extinguisher may be large enough to discharge enough retardant compound to extinguish a fire in a large room. To this end, the extinguisher may be mounted in a ceiling, wall, or a floor with an exposed fuse link and one or more outlets. Moreover, while the mounted extinguisher is illustrated as being entirely automatic, the extinguisher could include a manual release for manually triggering the extinguisher when a fire is detected.

To apprise the public of the scope of this invention, I make the following claims:

I claim:

1. An apparatus for extinguishing fires via a retardant material, the apparatus comprising:

a container forming a material chamber having first and second ends and forming at least one outlet at the second end;

a plunger positioned for movement within the container essentially between the first and the second ends;

a motivator for selectively moving the plunger through the chamber from the first to the second ends, said motivator activated by a trigger which includes an engagement member located completely within said container and operatively connected to the plunger, said engagement member comprising two separate sections, a rigid section and a deformable section connected by a link, said deformable section at least partially deformed within said container when said plunger is positioned proximate said first end; and a seal for the outlet, the seal openable to permit retardant material to pass through the outlet.

2. The apparatus of claim 1, wherein the motivator includes a biaser for biasing the plunger toward the second end and a trigger linked to the plunger and moveable between at least triggered and untriggered positions, in the untriggered position, the trigger maintaining the plunger in a position within the chamber and in the triggered position, the trigger allowing the biaser to move the plunger toward the second end.

3. The apparatus of claim 2 wherein the biaser is a spring.

4. The apparatus of claim 3 wherein the elongated engagement member is operatively connected to the plunger which is acted upon by the spring, the engagement member having a plurality of openings, and the trigger further comprises a pawl movable into and out of the openings to selectively engage the engagement member and prevent movement of the spring and the plunger.

5. The apparatus of claim 4 wherein the engagement member is an elongated ratchet member and said openings are located both in said rigid section and said deformable section.

6. The apparatus of claim 4 further comprising a handle fixed to the container, the handle forming a handle chamber, the engagement member and spring being at least partially positioned in the handle chamber, the pawl extending through the handle so as to be operable by the finger of a user to move the pawl out of engagement with the engagement member to release the plunger.

7. The apparatus of claim 6 wherein the pawl is biased for engagement to the engagement member.

8. The apparatus of claim 1 further comprising a liquid fire extinguishing substance in the container.

9. The apparatus of claim 1 further comprising a liquid dispersing nozzle at said outlet.

10. The apparatus of claim 1 wherein the seal opens in response to pressure within the container.

11. The apparatus of claim 10 wherein the seal is frangible, and movement of the plunger into the material chamber creates pressure sufficient to break the seal.

12. The apparatus of claim 1 wherein the plunger is a piston and the container is a cylinder, the piston sealing against the sides of the container to prevent the leakage of material past the piston.

13. The apparatus of claim 1 further comprising a reclosable cap for the outlet.

14. The apparatus of claim 1 wherein the container is at least partially transparent.

15. The apparatus of claim 1 wherein the container is formed of plastic.

16. The apparatus of claim 1 wherein the container is elongated.

17. The apparatus of claim 16 wherein the container is at least two feet long.

18. The apparatus of claim 1 wherein the shape of the container and plunger is rectangular.

19. The apparatus of claim 1 wherein the shape of the container and plunger is triangular.

20. The apparatus of claim 1 wherein the shape of the container and plunger is oval.

21. The apparatus of claim 1 wherein the retardant material includes a liquid fire extinguishing substance.

* * * * *